US008530829B2

(12) United States Patent
Hirano et al.

(10) Patent No.: US 8,530,829 B2
(45) Date of Patent: Sep. 10, 2013

(54) INDUCTIVELY COUPLED PLASMA MASS SPECTROSCOPY APPARATUS AND MEASURED DATA PROCESSING METHOD IN THE INDUCTIVELY COUPLED PLASMA MASS SPECTROSCOPY APPARATUS

(75) Inventors: Kazushi Hirano, Tokyo (JP); Tetsuya Kanda, Tokyo (JP)

(73) Assignee: Agilent Technologies, Inc., Santa Clara, CA (US)

( * ) Notice: Subject to any disclaimer, the term of this patent is extended or adjusted under 35 U.S.C. 154(b) by 52 days.

(21) Appl. No.: 13/237,179

(22) Filed: Sep. 20, 2011

(65) Prior Publication Data

US 2012/0074309 A1 Mar. 29, 2012

Related U.S. Application Data

(60) Provisional application No. 61/385,566, filed on Sep. 23, 2010.

(51) Int. Cl.
*H01J 49/26* (2006.01)

(52) U.S. Cl.
USPC ..... 250/282; 250/281; 250/287; 250/288

(58) Field of Classification Search
USPC ..... 250/281, 282, 287, 288
See application file for complete search history.

(56) References Cited

U.S. PATENT DOCUMENTS

| | | | | |
|---|---|---|---|---|
| 4,472,630 | A * | 9/1984 | Schoen | 250/281 |
| 5,105,082 | A * | 4/1992 | Maruo et al. | 250/288 |
| 5,264,697 | A * | 11/1993 | Nakagawa et al. | 250/291 |
| 5,463,219 | A * | 10/1995 | Buckley et al. | 250/281 |
| 5,880,466 | A * | 3/1999 | Benner | 250/281 |
| 6,878,931 | B1 * | 4/2005 | Roushall et al. | 250/287 |
| 7,482,580 | B2 * | 1/2009 | Prest et al. | 250/281 |
| 7,728,292 | B2 * | 6/2010 | Jolliffe et al. | 250/307 |
| 7,863,556 | B2 * | 1/2011 | Hidalgo et al. | 250/281 |
| 7,884,317 | B2 * | 2/2011 | Casper | 250/281 |
| 8,080,782 | B2 * | 12/2011 | Hidalgo et al. | 250/282 |
| 2008/0156982 | A1 * | 7/2008 | Casper | 250/287 |
| 2010/0252729 | A1 * | 10/2010 | Jolliffe et al. | 250/282 |

* cited by examiner

*Primary Examiner* — David A Vanore

(57) ABSTRACT

A method of determining a coefficient for converting an analog current value into a pulse count value in an inductively coupled plasma mass spectroscopy apparatus (ICP-MS) is described. The ICP-MS is configured to generate the pulse count value and the analog current value as a signal intensity indicating a density of an element in a sample to be measured.

15 Claims, 9 Drawing Sheets

INDUCTIVELY COUPLED PLASMA MASS SPECTROSCOPY APPARATUS AND MEASURED DATA PROCESSING METHOD IN THE INDUCTIVELY COUPLED PLASMA MASS SPECTROSCOPY APPARATUS

CROSS-REFERENCE TO RELATED APPLICATIONS

The present application is related to and claims priority under 35 U.S.C. §119(e) from U.S. Provisional Application No. 61/385,566 filed on Sep. 23, 2011 entitled "Inductively Coupled Plasma Mass Spectroscopy Apparatus and Measured Data Processing Method in the Inductively Coupled Plasma Mass Spectroscopy Apparatus." The entire disclosure of the referenced U.S. provisional application is specifically incorporated by reference.

BACKGROUND

Inductively coupled plasma mass spectroscopy (ICP-MS) apparatuses have a dynamic range of measured signals as wide as nine digits, and the signal measurement is usually performed by a plurality of methods in accordance with an intensity of the signal. Therefore, it is necessary to associate a plurality of types of measured values determined by the individual methods by calibration. Typically, there are adopted two methods including a pulse count method and an analog current method. The calibration in this case is performed by measuring in a calibration range that is an overlapping signal range in which the measured signals determined in the two methods are both effective and by determining a ratio between measured signal levels of both methods. This ratio is often referred to as the pulse-to-analog (P/A) coefficient. Typically, it is desirable to perform the calibration individually for each element to be measured because the ratio of signal levels is different depending on the element to be measured.

In general, in order to obtain an effective P/A coefficient of a certain mass number, it is necessary to calculate the P/A coefficient between the analog current value and the pulse count value determined in a P/A coefficient calibration range (hereinafter, referred to as calibration range) that is an overlapping signal intensity range in which both the analog current value and the pulse count value measured for the mass number are effective. In addition, the signal intensity with respect to the sample density is different depending on the element. Therefore, it is necessary in the known method to prepare samples for P/A coefficient calibration having different densities for each element so that a signal in the calibration range can be determined for each element, and to perform measurement for determining the P/A coefficient. As such, determination of the P/A coefficient by this known ICP-MS can be labor-intensive.

In another known system, a measured value of the element in the sample to be measured is used for determining the P/A coefficient, and the density of the element in the sample to be measured is uncertain. For this reason, if the sample to be measured contains a low density element such that only a measured value in the pulse only region can be determined even if the transmission ratio of an ion lens is maximized for each element, the measured value of the element can be outside the calibration range by adjustment of the transmission ratio of the ion lens. Therefore, the P/A coefficient cannot be determined for such element.

Further, in the known system, the voltage to be applied to the ion lens 30 is changed step by step so that the measured signal can be determined over a wide range for determining the measured value of each element securely in the calibration range for every desired element in the sample to be measured. This method needs a lot of time for measurement to determine the P/A coefficient because the measurement is performed at many voltage points.

In addition, in the known system special hardware is needed such as a comparator for comparing the measured analog signal voltage with some predetermined voltages so as to discriminate which signal region the measured signal belongs to. Therefore, it is not easy to perform the known method in connection with a known ICP-MS.

Moreover, in the known ICP-MS described above an element of the sample may have a mass number having a P/A coefficient that is not determined by the ICP-MS 1, or an element of the sample may have a signal intensity that cannot measured in the calibration range because the density in the sample for P/A calibration is too low.

In this case, it is regarded that the P/A coefficient of the element exists only in the mass number of the element, and an linear interpolation approach is adopted in which known P/A coefficients of two different mass numbers having a relationship that a mass number having an undetermined P/A coefficient exists between them are connected by a straight line and a value on the straight line of the mass number for which the P/A coefficient is to be determined is regarded as an estimated value of the P/A coefficient of the mass number.

FIG. 11 is a graph showing an example of estimation of the P/A coefficient by the known linear interpolation based on a dependence of the P/A coefficient on the mass number. The horizontal axis (x axis) represents the mass number, and the vertical axis (y axis) represents the P/A coefficient. Five points indicated by squares in the graph are obtained by plotting the P/A coefficients that are determined in advance in the ICP-MS 1 with respect to the mass numbers.

Each of the four straight lines illustrated by the dot lines in FIG. 11 connects two points having neighboring mass numbers among the five points. For instance, the straight line part L in FIG. 11 connects the P/A coefficients corresponding to the mass numbers of 69 amu and 238 amu, respectively. The P/A coefficient corresponding to the mass number of 137 of the element Ba between the two mass numbers is estimated as a y coordinate value when the x coordinate value is 137 in the linear equation representing the straight line L.

However, the P/A coefficient depends not just on the mass number, and hence an error of the estimated value is apt to increase relatively when the P/A coefficient is estimated by the linear interpolation on the basis of only the dependence on the mass number.

What is needed therefore is a method and apparatus for estimating a P/A coefficient that overcomes at least the drawbacks of known methods described above.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

In the accompanying drawings.

DETAILED DESCRIPTION

In the following detailed description, for purposes of explanation and not limitation, representative embodiments disclosing specific details are set forth in order to provide a thorough understanding of the present teachings. Descriptions of known devices, materials and manufacturing methods may be omitted so as to avoid obscuring the description of the example embodiments. Nonetheless, such devices, materials and methods that are within the purview of one of ordinary skill in the art may be used in accordance with the representative embodiments.

The present invention teachings relate generally to an inductively coupled plasma mass spectroscopy apparatus (ICP-MS), and more particularly, to a method of processing measured data determined by the inductively coupled plasma mass spectroscopy apparatus. A first aspect of the present teachings is directed to a structure and a method for determining a P/A coefficient by utilizing conventionally-employed measurement of a standard density sample for generating a working curve. A second aspect of the present teachings is directed to a P/A coefficient estimation method for estimating more precisely, in the case where a mass number for which a P/A coefficient is not determined exists, the P/A coefficient of the mass number on the basis of a correlation between two P/A coefficient sequences determined by different measurements in a given ICP-MS. Hereinafter, first and second representative embodiments illustrating first and second aspects of the present teachings are described.

Figure 1:
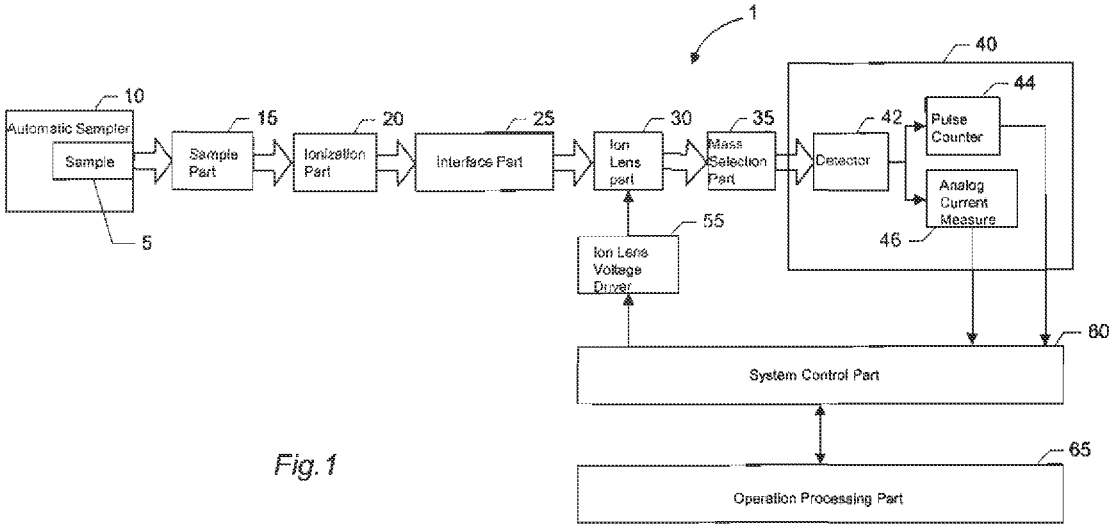
FIG. 1 is a block diagram of an ICP-MS that can measure a pulse count value and an analog current value simultaneously or selectively.

FIG. 1 illustrates a block diagram of an ICP-MS 1 that can measure a pulse count value and an analog current value simultaneously or selectively. An automatic sampler 10 contacts a sample suction tube connected to a sample input 15 with liquid of sample 5 to be measured in a sample holder. The sample 5 is led from the sample input 15 to an ionizer 20, and elements included in the sample 5 are ionized by plasma generated in the ionizer 20. The ionized elements are sampled in an interface 25 constituting a differential exhaust system including a sampling cone and a skimmer cone (not shown), and are led into a high vacuum chamber including an ion lens 30, a mass analyzer 35, and a detector 42. Then, the ionized elements are focused by the ion lens 30 and enter the mass analyzer 35 that typically comprises a quadrupole mass filter for transmitting only ions of a selected mass number.

The detector 42 typically comprises a secondary electron multiplier, and outputs an electric signal corresponding to the number of ions of the mass number segregated by the mass analyzer 35 per unit time. The electric signal output from the secondary electron multiplier is provided to a pulse counter 44 and an analog current measuring part 46. Then, a pulse count value corresponding to a pulse frequency of the electric signal and an analog current value of the electric signal are measured by the pulse counter 44 and the analog current measuring part 46, respectively. The detector 42, the pulse counter 44, and the analog current measuring part 46 constitute an ion measuring part 40.

An ion lens voltage driver 55 is configured to apply a voltage to the ion lens 30. The ion lens 30 includes an electric field lens unit configured to change trajectories of ions by applying an electric field, and is constructed such that an ion transmission ratio changes in accordance with a change of the voltage applied to an electrode of the ion lens 30. Among other functions, a system controller 60 controls the ion lens voltage driver 55, which changes the voltage applied to the electrode of the ion lens 30. As such, the ion transmission ratio of the ion lens 30 can be increased or decreased by changing the voltage applied to the electrode of the ion lens 30. In a typical measurement, the voltage applied to the ion lens 30 is set to a predetermined voltage such that a transmission ratio of every element to be a target of analysis in the sample to be measured is maximized.

An operation processor 65 compares the intensity of the measured signal against a predetermined value in the normal measurement for quantifying the density of an element in the sample to be measured. If the intensity is larger than the predetermined value, the analog current value from the analog current measuring part 46 is adopted as the effective measured value. If the intensity is smaller than the predetermined value, the pulse count value from the pulse counter 44 is adopted as the effective measured value. This is because the pulse count value may be saturated in a region having large signal intensity, while a signal-to-noise (S/N) ratio of the analog current is likely deteriorated in the region having small signal intensity. Therefore, it is necessary to adopt a measured value having higher reliability in accordance with signal intensity. The operation processor 65 performs a process of determining a ratio between the measured values (P/A coefficient) for converting the measured analog current value into the pulse count value for each mass number.

All or part of the various process operations described in accordance with representative embodiments below (e.g., in connection with FIGS. 2, 3 and 7) may be performed by a processing device (e.g., operation processor 65). The processing device is configured to execute an algorithm and/or process according to representative embodiments described below.

The operation processor 65 and the system controller 60 may each comprise a software-controlled controller or microprocessor, hard-wired logic circuits, firmware, or a combination thereof and are configured to implement the methods of processing measured data determined by the ICP-MS 1 apparatus in accordance with representative embodiments described below. Also, while the parts are functionally segregated for explanation purposes, they may be combined variously in any physical implementation.

In the depicted embodiment, the operation processor 65 and system controller 60 each comprise a memory and various interfaces (not shown). In conjunction with the memory, the operation processor 65 and the system controller 60 are configured to execute one or more logical or mathematical algorithms, including the methods of processing measured data determined by the ICP-MS 1 in accordance with representative embodiments described below. The operation processor 65 and the system controller 60 each may be constructed of a combination of hardware, firmware or software architectures, and include their own memory (e.g., nonvolatile memory) for storing executable software/firmware executable code that allows them to perform the various functions including the including the methods of processing measured data determined by the ICP-MS 1 in accordance with representative embodiments. Alternatively, the executable code may be stored in designated memory locations within the memory. Illustratively, the system controller 60 may be a central processing unit (CPU), for example, and may execute an operating system.

The memory may be any number, type and combination of external and internal nonvolatile read only memory (ROM) and volatile random access memory (RAM), and stores various types of information, such as signals and/or computer programs and software algorithms executable by the system controller 60 and/or the operation processor 65 and/or other components of the ICP-MS 1. The memory may include any number, type and combination of tangible computer readable storage media, such as a disk drive, an electrically programmable read-only memory (EPROM), an electrically erasable and programmable read only memory (EEPROM), a CD, a DVD, a universal serial bus (USB) drive, and the like.

1. First Representative Embodiment

The first aspect of the present teachings can be performed in an ICP-MS using software incorporated therein, as will become clearer from the description of the first representative embodiment below. As described more fully below, the ICP-MS 1 in which the present teachings are performed comprises means for adjusting a voltage applied to an ion lens 30 in accordance with a measured signal intensity to thereby adjust an ion transmission ratio of the ion lens 30. The means for adjusting the voltage control to the ion lens voltage driver 55 and the system controller 60 for controlling the ion lens voltage driver 55 may be realized using devices and circuits within the purview of one of ordinary skill in the art. The system controller 60 usefully adjusts the voltage applied to the ion lens 30 via the ion lens voltage driver 55.

Figure 2:
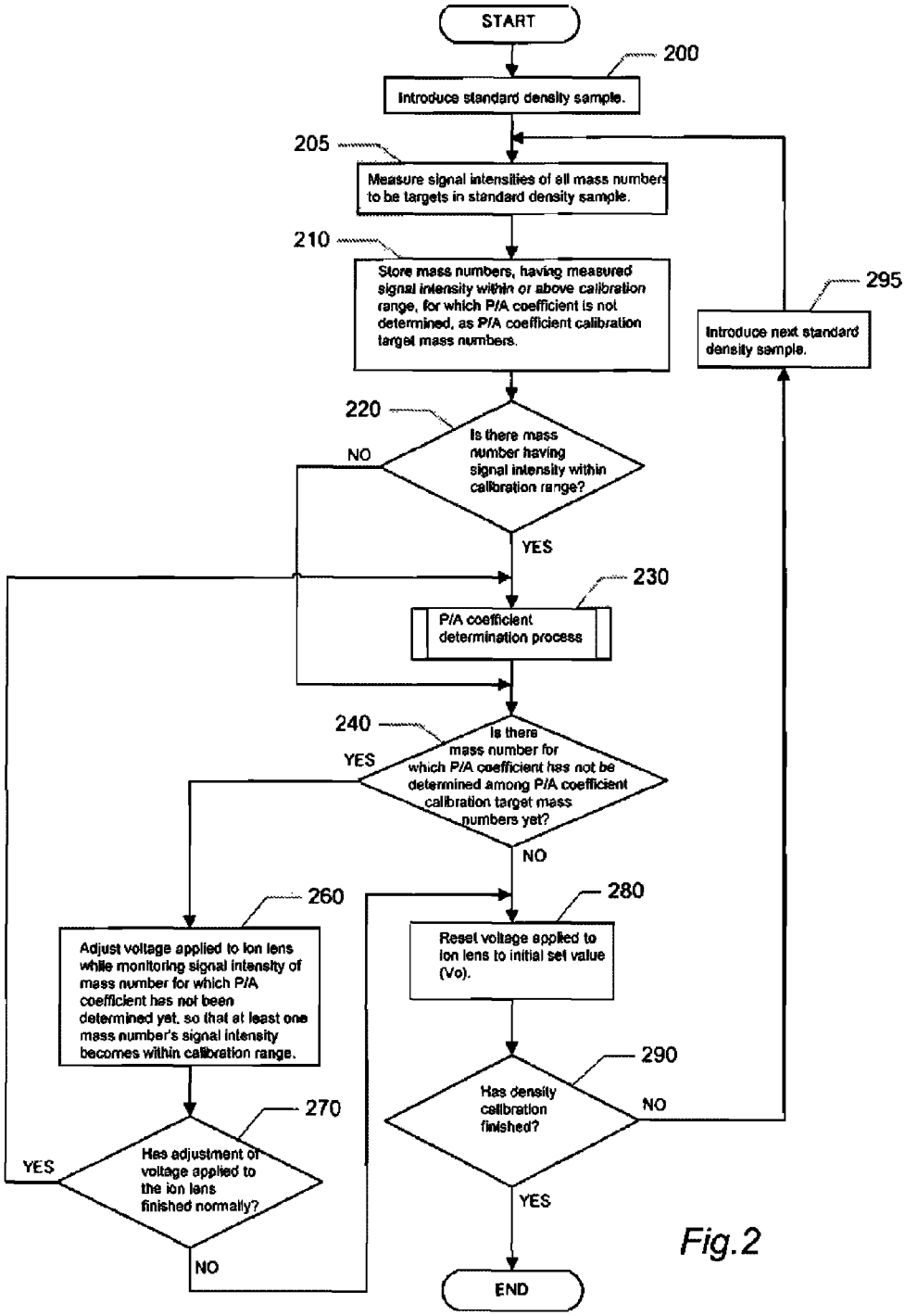
FIG. 2 is a flow chart illustrating a process in accordance with a representative embodiment.

With reference to a flowchart illustrated in FIG. 2, a method in accordance with a representative embodiment is described in connection with the ICP-MS 1 having the structure illustrated in FIG. 1.

In the illustrative method, both the pulse count value and the analog current value can be measured simultaneously. Notably, the voltage applied to the ion lens 30 is set to a predetermined initial value ($V_0$) when the measurement of a sample is started, similarly to the measurement for a known density calibration.

First, in Step 200, a standard density sample is introduced into the ICP-MS 1. In general, a predetermined standard density sample that is used for measurement for one density calibration is prepared as one or more standard density samples. The standard density samples constituting the predetermined standard density sample contain the same element, but the density of the same element is different among the standard density samples, and is selected so that the density of the element estimated to be contained in the sample to be measured is equal to or smaller than a maximum density of the standard density sample containing the element at the maximum density.

Illustratively, the first representative embodiment is described for the case where the following set of standard density samples 1 to 3 are used as the standard density sample to be used in measurement for one density calibration. The densities of elements contained in the standard density sample 1 are 10 ppb and 1 ppm, the densities of elements contained in the standard density sample 2 are 50 ppb and 5 ppm, and the densities of elements contained in the standard density sample 3 are 100 ppb and 10 ppm. In addition, the elements having the densities of 10 ppb, 50 ppb, and 100 ppb in the standard density samples are Be, Al, Ca, V, Cr, Mn, Fe, Co, Ni, Cu, Zn, As, Se, Mo, Ag, Cd, Sb, Ba, Tl, Pb, Th, and U (having mass numbers of 9, 27, 43, 51, 53, 55, 57, 59, 60, 63, 66, 75, 82, 95, 107, 111, 121, 137, 205, 208, 232, and 238 amu, respectively). The elements having the densities of 1 ppm, 5 ppm, and 10 ppm are Na, Mg, K, Fe, and Sr (having mass numbers of 23, 24, 39, 56, 88 amu, respectively).

Moreover, the standard density samples are introduced into the ICP-MS 1 in order of increasing density of element as is common for one density calibration. Therefore, the standard density sample 1 is first introduced into the ICP-MS 1, and signal intensities of all mass numbers to be targets of the density calibration in the sample are measured in Step 205.

The signal intensities determined for the mass numbers in the sample are measured simultaneously as the pulse count value and the analog current value by the pulse counter 44 and the analog current measuring part 46 illustrated in FIG. 1. The measured values determined in this way are associated with corresponding mass numbers and are stored in a memory (not shown) in the operation processor 65. Notably, the series of the processes from the introduction of the sample to obtaining of the measured data in the ICP-MS 1 is performed not only in the density calibration but also in other components of the ICP-MS 1 under the control of the system controller 60. Such control and operation of the components are known to one of ordinary skill in the art, and therefore detailed descriptions thereof are omitted.

Figure 5:
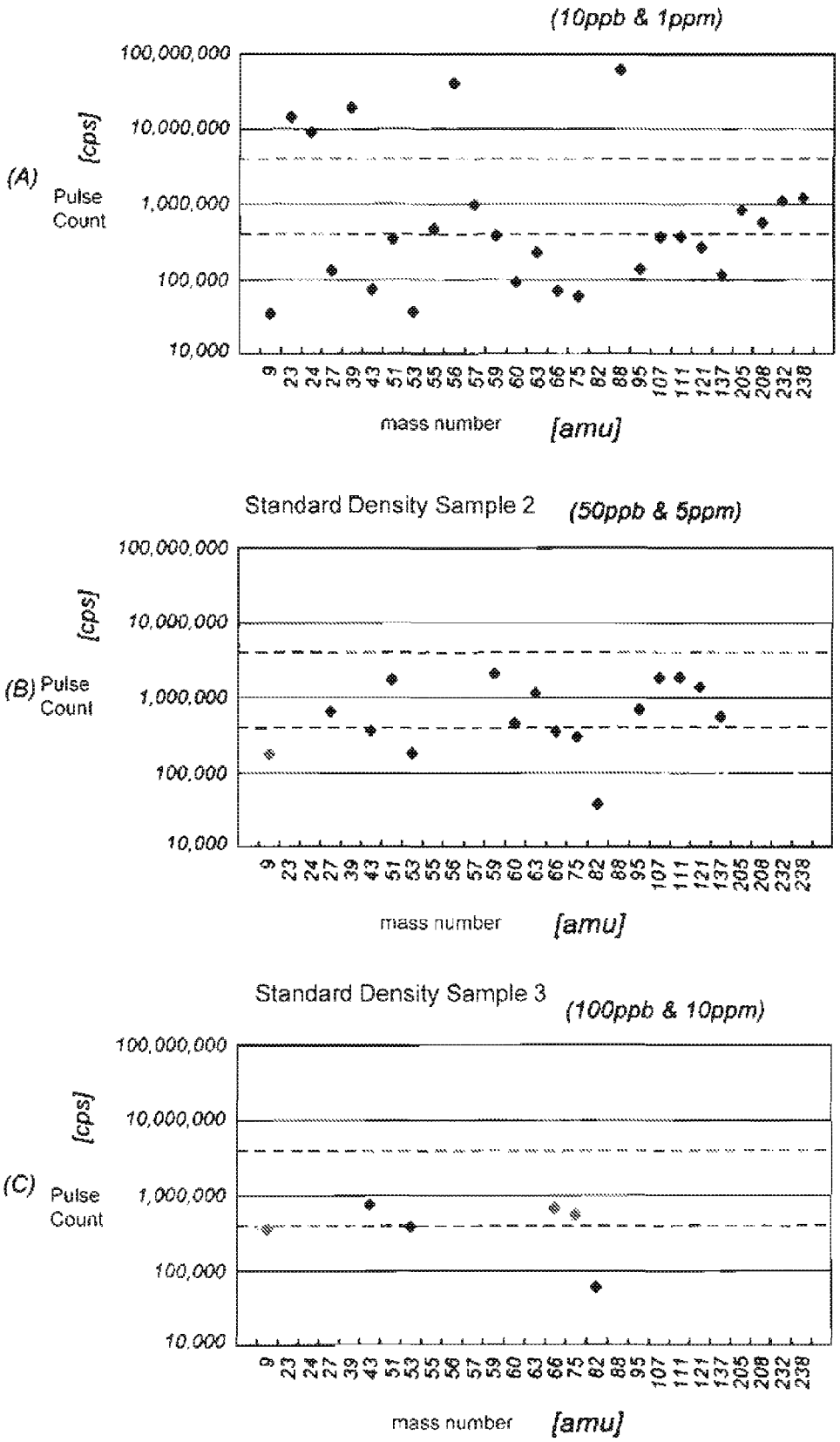
FIGS. 5A, 5B, and 5C are graphs illustrating results of measurement for density calibration performed for each of standard density samples 1, 2, and 3 that are used in measurement for one density calibration in a representative embodiment. In the graph of FIG. 5B, mass numbers having the P/A coefficients determined by using the standard density sample 1 are not plotted. Further, in the graph of FIG. 5C, mass numbers having the P/A coefficients determined by using the standard density samples 1 and 2 are not plotted.

FIG. 5A illustrates signal intensities of the mass numbers in the standard density sample 1, which are measured as described above. In the interest of simplicity of description, the measured signal intensities depicted in FIGS. 5A~5C and 6 in the signal intensity range above the calibration range are converted into the pulse count values. In the graphs of FIGS.

5A~5C and 6, the range enclosed by two dot lines having pulse count values of approximately 560 Kcps to 5.6 Mcps is the calibration range.

Next, in Step 210, the system controller 60 discriminates a mass number having measured signal intensity within the calibration range and a mass number having measured signal intensity above the calibration range, and stores the mass numbers in the memory as mass numbers for which the P/A coefficient should be determined (hereinafter, referred to as P/A coefficient calibration target mass numbers).

Next, in Step 220, if there is a mass number for which the signal intensity is measured within the calibration range, the system controller 60 regards the mass as a P/A coefficient mass number that can be calibrated ("P/A coefficient calibratable mass number") and stores the signal intensity of the mass number measured in the calibration range (analog current value and pulse count value measured simultaneously) in the memory in association with the mass number. Then, the process proceeds to the P/A coefficient determining process (step 230) for determining the P/A coefficient from the analog current value and the pulse count value. If such a mass number does not exist, the process proceeds to Step 240. In the measurement example illustrated in FIG. 5A, signal intensities of six mass numbers including the mass numbers 55, 57, 205, 208, 232, and 238 are in the calibration range. Therefore, these mass numbers are regarded as the P/A coefficient calibratable mass numbers, and the P/A coefficients of the six mass numbers are determined first in Step 230.

Figure 3:
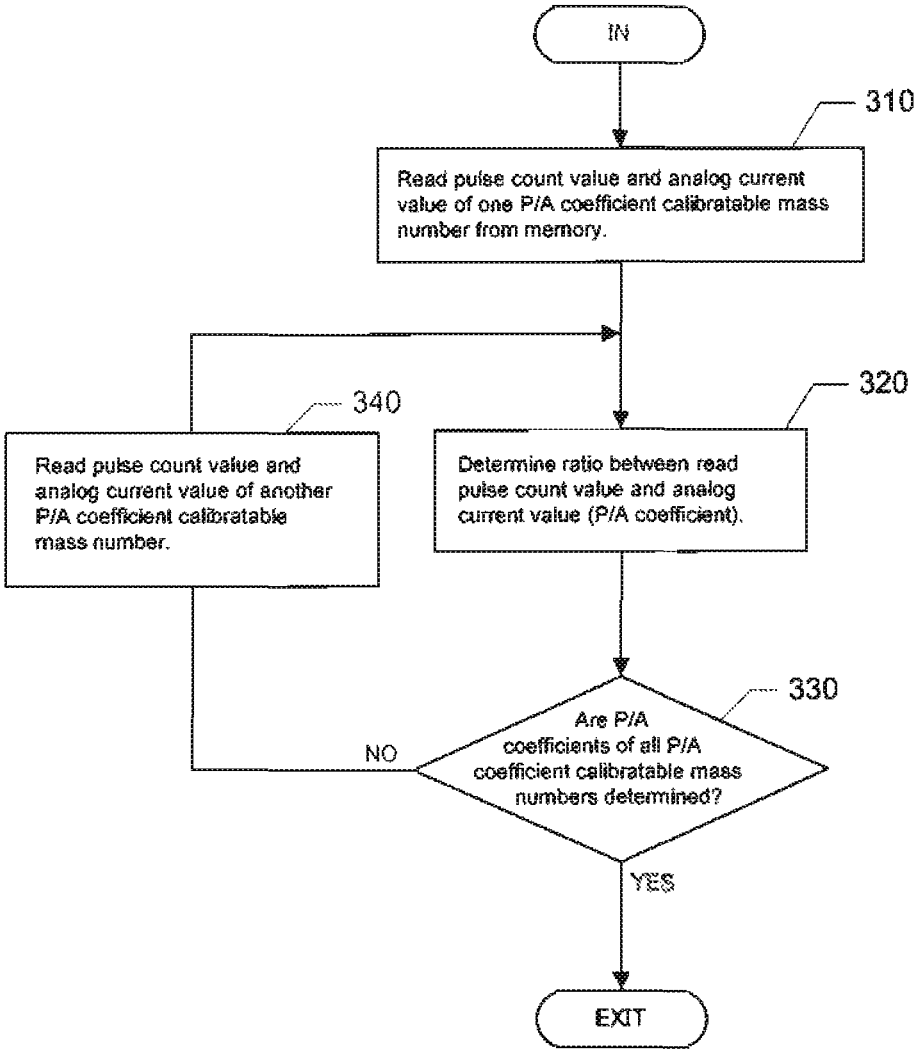
FIG. 3 is a flow chart illustrating P/A coefficient determining process according to a representative embodiment.

FIG. 3 is a flow chart illustrating the P/A coefficient determining process according to the first representative embodiment. In Step 310, the operation processor 65 reads from memory the pulse count value and the analog current value of one mass number among the P/A coefficient calibratable mass numbers discriminated to have the signal intensity within the calibration range. Next, in Step 320, a ratio between the read pulse count value and the analog current value (P/A coefficient) is determined. In Step 330, it is determined whether or not the P/A coefficient of every P/A coefficient calibratable mass number has been determined. If there is a P/A coefficient calibratable mass number for which the P/A coefficient has not yet been determined, the pulse count value and the analog current value of another P/A coefficient calibratable mass number are read from the memory in Step 340, and the P/A coefficient of the another mass number is determined from the values in Step 320. Subsequently, and in the same manner, the loop including Steps 320, 330, and 340 is repeated. When it is determined that the P/A coefficient is determined for every P/A coefficient calibratable mass number in Step 330, the process exits Step 230 (FIG. 2).

Referring again to FIG. 2, when the P/A coefficient determining process in Step 230 is completed, the process proceeds to Step 240, in which the system controller 60 determines whether or not there is a mass number for which the P/A coefficient has not been determined yet among the P/A coefficient calibration target mass numbers stored in the memory in Step 210. Here, when Step 240 is performed for the first time, the P/A coefficient is already determined in Step 230 for every mass number discriminated to have signal intensity measured within the calibration range in Step 210 among the P/A coefficient calibration target mass numbers. Therefore, the mass number for which the P/A coefficient is not determined at this stage is the mass number discriminated to have the signal intensity above the calibration range in Step 210. On the other hand, when Step 240 is performed for the second or subsequent time, the number of the mass numbers for which the P/A coefficient is not determined is decreased by the number of mass numbers for which the P/A coefficient is determined in Step 230 performed for the second time and later.

The mass number for which it is determined that the P/A coefficient is not determined in Step 240 corresponds to a mass number for which the signal intensity is not measured at all in the calibration range. Therefore, in this state, the P/A coefficient cannot be determined for the mass number. Therefore, when it is determined in Step 240 that there is such a mass number, the system controller 60 controls the ICP-MS 1 in Step 260 so as to measure the signal intensity of every mass number for which the P/A coefficient is not determined yet among the P/A coefficient calibration target mass numbers. Then, the measured values are monitored, and a voltage applied to the ion lens 30 is adjusted successively (via control of the ion lens voltage driver 55) in the direction of increasing or decreasing the ion transmission ratio of the ion lens 30 so that the signal intensity of at least one mass number among the measured values is measured in the calibration range. Here, the applied voltage is adjusted in the direction of increasing the transmission ratio of the ion lens 30 in the case where the adjustment of the voltage applied to the ion lens 30 in the direction of decreasing the transmission ratio of the ion lens 30 causes the signal intensity that is measured above the calibration range in the measurement just before the adjustment to drop past and below the calibration range. In this way, the voltage applied to the ion lens 30 is adjusted in the direction of increasing the transmission ratio of the ion lens 30 so that the signal intensity is measured within the calibration range for the mass number for which the signal intensity has dropped from the region above the calibration range to the region below the calibration range without being measured within the calibration range by the adjustment of the voltage applied to the ion lens 30.

In Step 260, the mass number for which the signal intensity is measured within the calibration range is regarded as the P/A coefficient calibratable mass number by the adjustment of the voltage applied to the ion lens 30. Then, in the same manner as described above, in Step 230, the P/A coefficients of the mass numbers are determined from the measured values of the mass numbers when being measured within the calibration range. Here, the ion transmission ratio of the ion lens 30 can be adjusted continuously between a point where the signal intensity measured for an arbitrary mass number becomes maximum and a point where the same becomes substantially zero by changing appropriately the voltage applied to the ion lens 30. Therefore, by repeating Steps 240, 260, and 230 appropriately, the signal intensity can be measured within the calibration range at least one time for each of the P/A coefficient calibration target mass numbers. Thus, the P/A coefficient can be determined. Notably, in Step 260, by measuring only the signal intensity of the mass number for which the P/A coefficient is not determined yet, redundant measurement of the signal intensity of the mass number for which the P/A coefficient is once determined is avoided. As such, the redundant determination of the P/A coefficient for the sample that is being measured is avoided. By combining the process with the process in Step 210 to be described later for the standard density samples 2 and 3, it is possible to avoid redundant measurement of the signal intensity in measurement of an arbitrary standard sample introduced for the same one density calibration, not only for the mass number for which the P/A coefficient is already determined from measurement of the standard sample, but also for the mass number for which the P/A coefficient is already determined from measurement of another arbitrary standard density sample that is introduced for the same one density calibration. Therefore, it is possible to avoid redundant determination of the P/A coefficient of the same mass number for every standard density sample introduced for the same density calibration.

For purposes of illustration, the process in Steps 230, 240, and 260 with respect to the standard density sample 1 is described. In the graph of FIG. 5A, the P/A coefficient calibration target mass numbers in the standard density sample 1 include eleven mass numbers of 23, 24, 39, 55, 56, 57, 88, 205, 208, 232, and 238. Among them, five mass numbers of 23, 24, 39, 56, and 88 exceed the calibration range. These five mass numbers are excluded from targets of the P/A coefficient determining process in Step 230 that is performed for the first time. Therefore, in the next Step 240, these five mass numbers are determined to be mass numbers for which the P/A coefficient is not determined. As a result, the process proceeds to Step 260. In Step 260, the system controller 60 adjusts a voltage applied to the ion lens 30 via control of the ion lens voltage driver 55 while monitoring signal intensities of the five mass numbers, so that the signal intensity of at least one mass number among the five mass numbers is measured within the calibration range. In the present example, in order that the signal intensity of at least one of the five mass numbers is within the calibration range, the voltage applied to the ion lens 30 is adjusted in the direction of decreasing the ion transmission ratio of the ion lens 30. For that purpose, this embodiment adopts a method of adjusting the voltage applied to the ion lens 30 so that the lowest signal intensity among the signal intensities of the five mass numbers becomes a predetermined level within the calibration range (e.g., approximately 1 Mcps).

Figure 6:
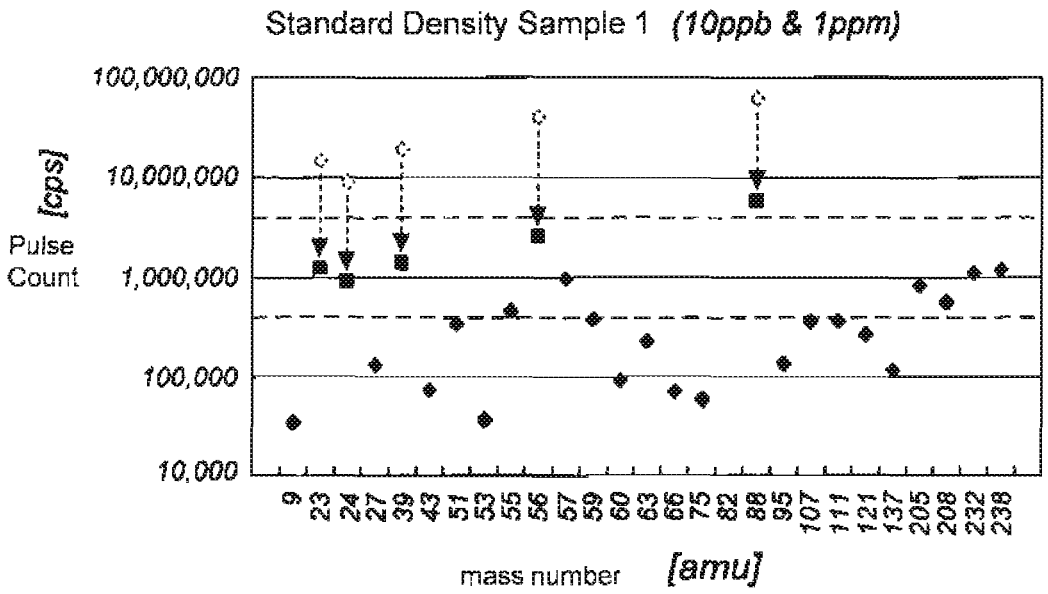
FIG. 6 is a graph showing a process for determining the P/A coefficient from a signal determined by measurement for density calibration and a signal determined by measurement following adjustment of a voltage applied to an ion lens 30 together with FIG. 5A according to a representative embodiment.

The graph of FIG. 6 illustrates the signal intensities of the mass numbers plotted when the voltage applied to the ion lens 30 in Step 260 is adjusted by a predetermined amount from the state of measurement of FIG. 5A, so that the signal intensity of element Mg with the mass number of 24 having the lowest signal intensity among the five mass numbers becomes approximately 1 Mcps.

In the graph of FIG. 6, the signal intensities of mass numbers (except the rightmost mass number 88) among the five mass numbers 23, 24, 39, 56, and 88 having had the signal intensities above the calibration range in FIG. 5A are now within the calibration range. Therefore, the P/A coefficients can be determined for the mass numbers 23, 24, 39, and 56 at this time point, so in Step 260, these mass numbers are regarded as the P/A coefficient calibratable mass numbers.

Next, the process proceeds to Step 230 in which the system controller 60 determines P/A coefficients of the five P/A coefficient calibratable mass numbers by the operation processor 65 in the same manner as described above.

The process proceeds to Step 240 in which it is determined whether or not there is any mass number for which the P/A coefficient is not determined yet among the P/A coefficient calibration target mass numbers. In the measurement example of FIG. 6, only the signal intensity of the mass number 88 still exceeds the calibration range. Therefore, the process proceeds to Step 260 in which the voltage applied to the ion lens 30 is adjusted so that the signal intensity of the element having the mass number 88 becomes approximately 1 Mcps this time. After that, only the mass number 88 is regarded as the P/A coefficient calibratable mass number, so that the P/A coefficient of the element having the mass number 88 is determined in Step 230.

The loop comprising Steps 240, 260, 270, and 230 is repeated as necessary, so that the P/A coefficient is determined for each of the five mass numbers recognized by performing Step 240 for the first time. In addition, the P/A coefficients for six mass numbers 55, 57, 205, 208, 232, and 238 are also determined by performing Step 230 for the first time as described above. Finally, the P/A coefficient is determined for each of the eleven P/A coefficient calibration target mass numbers in the standard density sample 1.

Notably, Step 270 is a fault detection step. If it is not determined in the step that the adjustment of the voltage applied to the ion lens 30 is correct, it is determined that an abnormal state has occurred in the measurement sequence, and the measurement process of the current sample is terminated.

After exiting the loop, the process proceeds to Step 280 in which the voltage applied to the ion lens 30 is reset to the initial value $V_o$. At Step 290 it is determined whether or not the density calibration is completed. Specifically, it is determined whether or not the density calibration is completed for all mass numbers to be targets of the density calibration from the measured values of all standard density samples prepared for one density calibration. If the density calibration is not finished, the standard density sample having the next lowest density is introduced into the ICP-MS 1 in Step 295, so that the same process is performed for the sample. In this example, the measurement is not performed for the standard density samples 2 and 3. Therefore, the process proceeds from Step 290 to Step 295 in which the standard density sample 2 is introduced into the ICP-MS 1, and the process commences again for the sample from Step 205 that is the measurement step for the density calibration similarly to the standard density sample 1.

FIG. 5B illustrates a result of the measurement performed for the standard density sample 2 in Step 205. In Step 205, signal intensities of all elements contained in the standard density sample 2 are measured, but the measured values of mass numbers for which the P/A coefficient is already determined in the standard density sample 1 among the elements are not plotted in FIG. 5B. In addition, it is not necessary to determine the P/A coefficient for the mass numbers for which the P/A coefficient has been already determined in the standard density sample 1. Therefore, as described above, in order to avoid redundant determination of the P/A coefficient in the measurement of the standard density sample introduced for the same one density calibration, these mass numbers are excluded from the P/A coefficient calibration target mass numbers in Step 210. As such, these mass numbers are excluded from targets of the P/A coefficient determining process (step 230) and the associated Steps 240 and 260. In the measurement example illustrated in FIG. 5B, the mass numbers 23, 24, 39, 55, 56, 57, 88, 205, 208, 232, and 238 are excluded from targets of the P/A coefficient determining process. Therefore, the P/A coefficient calibration target mass numbers recognized for the standard density sample 2 in Step 210 are only mass numbers having signal intensities within the calibration range illustrated as a region between two dotted lines in FIG. 5B.

As understood from comparison between FIG. 5A and FIG. 5B, some of the mass numbers having the signal intensities below the calibration range (e.g., the mass number 27) in the measurement of the standard density sample 1 in Step 205 are raised to the inside of the calibration range in the measurement of the standard density sample 2 in Step 205. This is because the densities of the elements having the mass numbers in the standard density sample 2 are higher than densities thereof in the standard density sample 1. Therefore, the mass numbers in the calibration range (except mass numbers for which the P/A coefficient is already determined) are recognized as the P/A coefficient calibratable mass numbers in Step 220, so that the P/A coefficient determining process in Step 230 is performed for the mass numbers. On the other hand, in FIG. 5B, there is no mass number having a signal intensity above the calibration range except for the mass numbers (not shown) for which the P/A coefficient is already determined. Accordingly, Steps 260 and 270 are not performed for the standard density sample 2.

When the P/A coefficient is determined for each of the P/A coefficient calibration target mass numbers in the standard density sample 2, the process proceeds to Step 295 via Steps 240, 280 and Step 290. Notably, in this case, the voltage applied to the ion lens 30 remains $V_o$ so that Step 280 may not be performed. The standard density sample 3 having the highest density is introduced into the ICP-MS 1 in Step 295, and after that, similarly to the standard density sample 1, the process is started from Step 205 that is a measurement step for the density calibration.

FIG. 5C illustrates a result of the measurement performed for the standard density sample 3 in Step 205. In Step 205, signal intensities of all mass numbers included in the standard density sample 3 are measured, but measured values of mass numbers for which the P/A coefficient is already determined in the standard density samples 1 and 2 are not plotted in FIG. 5C. In addition, also for the standard density sample 3, the mass numbers for which the P/A coefficient is already determined in the standard density samples 1 and 2 are excluded from the P/A coefficient calibration target mass numbers in Step 210. Therefore, these mass numbers are excluded from targets of the P/A coefficient determining process in Step 230. Accordingly, the P/A coefficient calibration target mass numbers recognized for the standard density sample 3 in Step 210 are only mass numbers having signal intensities within the calibration range illustrated as a region between two dot lines in FIG. 5C.

As can be appreciated from a comparison of FIG. 5B and FIG. 5C, some of the mass numbers having signal intensities below the calibration range (e.g., mass number 43) in the measurement of the standard density sample 2 in Step 205 are raised to the inside of the calibration range in the measurement of the standard density sample 3 in Step 205. This is because the densities of the elements having the mass numbers in the standard density sample 3 are higher than densities thereof in the standard density sample 2. Therefore, the mass numbers in the calibration range (except mass numbers for which the P/A coefficient is already determined) are recognized as the P/A coefficient calibratable mass numbers in Step 220, so that the P/A coefficient determining process in Step 230 is performed for the mass numbers. On the other hand, in FIG. 5C, there is no mass number having a signal intensity above the calibration range except for the mass numbers (not shown) for which the P/A coefficient is already determined. Therefore, Step 260 and 270 are not performed for the standard density sample 3.

Notably, there is no mass number having the signal intensity above the calibration range in each of the standard density samples 2 and 3 as measurement targets in this example, except for the mass numbers for which the P/A coefficient is already determined, as a result of measurement in Step 205. However, there may be a case where there is a mass number having a signal intensity above the calibration range besides the mass number for which the P/A coefficient is already determined, depending on the mass numbers contained in the standard density samples and/or the density of the element of the mass number, in Step 240 that is performed for the first time. In this case, the loop of Step 240, 260, 270, and 230 is performed for the mass numbers in the standard density sample 2 and/or 3 above the calibration range in a manner similar to the above description for the standard density sample 1.

Figure 4:
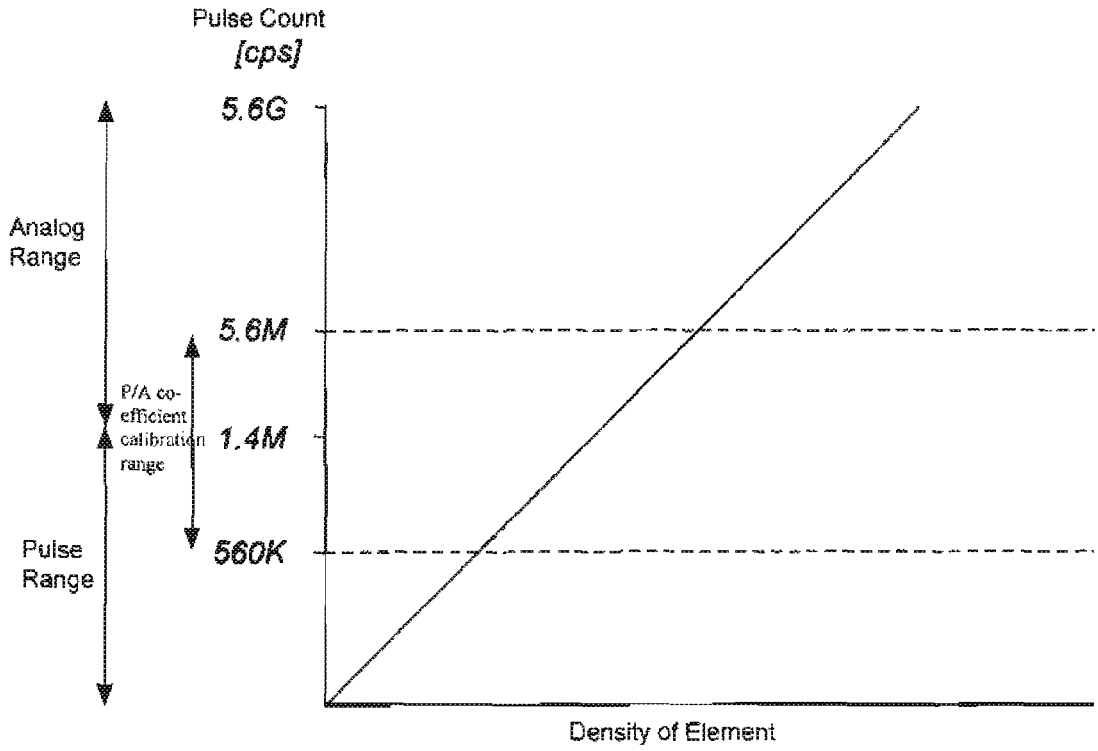
FIG. 4 illustrates an example of a working curve that can be determined as a result when a representative embodiment is performed.

In accordance with the method of the first representative embodiment, when the P/A coefficients of all the P/A coefficient calibration target mass numbers are determined by the measurement of the three standard density samples, the measured value of the signal intensity at each density is determined as both a pulse count value and an analog current value for each of the P/A coefficient calibration target mass numbers by the measurement in Steps 205 and 260. As such, the effective analog current values measured in the signal intensity range within and above the calibration range are multiplied to the P/A coefficient determined in this way, so that the analog current value in the range can be converted into the effective pulse count value. Therefore, among the measured values determined for each of the standard density samples 1, 2 and 3 in Step 205, the analog current value measured in the signal intensity range above a predetermined signal intensity that is set within the calibration range is converted into the pulse count value and is plotted, while a pulse count value is plotted for the measured value determined in the signal intensity range below the predetermined signal intensity, with respect to each density of each element of the mass number in the standard density samples 1, 2 and 3. Then a calibration curve connecting the plotted points (typically a straight line) is determined, so that a working curve can be drawn over the pulse range to the analog range as illustrated in FIG. 4, in which the signal intensity is expressed only by pulse count values.

Furthermore, when the measurement of each of the standard samples introduced for one density calibration is completed for every mass number to be the target of the P/A coefficient determination, and thereafter another new measurement is performed for one density calibration, the P/A coefficient is determined again for every mass number to be the target of the P/A coefficient determination. As such, in accordance with the first representative embodiment, every time a new measurement for one density calibration is performed, the P/A coefficients that have already been determined in relation with any other one density calibration are reset.

In accordance with one illustrative implementation of the first representative embodiment, the series of processes for the P/A coefficient determination described above with reference to FIG. 2 may be performed by operating individual components ("blocks") illustrated in FIG. 1 on the basis of control by the software incorporated in the system controller 60. In particular, the P/A coefficient determining process in Step 230 can be performed by the operation processor 65. Therefore, the series of processes performed after the user introduces the standard density sample into the ICP-MS 1 can be performed automatically. As noted above, each of the system controller 60 and the operation processor 65 can be typically constructed of a microprocessor and memory from which the microprocessor can read from and write to. Therefore, the processes of the P/A coefficient determination in Step 230 and the related Steps 240, 260, and 270 can be performed by one of the system controller 60 and the operation processor 65, or may be performed and shared by both the system controller 60 and the operation processor appropriately depending on design requirements, as a design matter.

Further, the P/A coefficient is not determined for a mass number for which the signal intensity has been measured only in the pulse range below the calibration range even by the adjustment of the voltage applied to the ion lens 30 because of low density in the standard density sample. It is usually expected that the signal intensity is measured for the mass number originally by the pulse count value. Therefore, there is little practical problem even if the P/A coefficient cannot be determined for such mass number. However, there is a case where the estimated value of the P/A coefficient can be determined also for such mass numbers by using the P/A coefficient estimation method of the present teachings to be described later in the second embodiment.

In addition, although a plurality of samples are used as the standard density sample for one density calibration in the above description, it is possible to use only one standard density sample having a density equal to or larger than the density expected for each of the desired mass numbers in the sample to be measured. In this case, too, the process can be performed in the same manner as described above for the standard density sample 1.

The above description describes the case where this embodiment is performed by the ICP-MS 1 apparatus that can measure both the pulse count value and the analog current value at the same time. However, the present teachings are contemplated to be performed by the ICP-MS 1 configured to measure the pulse count value and the analog current value selectively, in the same manner, though some measurement error may be generated due to such switching.

Furthermore, according to the methods of determining the P/A coefficient of the present teachings, density information of each element can also be determined at the same time as the determination of the P/A coefficient. Therefore, even if a signal that is used for determining a P/A coefficient of an element of a certain mass number is affected by molecular ion interference, the degree of the effect can be monitored. As such, if the degree of the effect of molecular ion interference exceeds a predetermined standard, in the measurement for a plurality of standard samples introduced for the same one density calibration, the P/A coefficient determined from the measured value of the standard density sample containing higher density of element of the mass number is adopted with a priority, so that the degree of effect of the molecular ion interference on the element of the mass number can be appropriately reduced. In this way, in order to obtain the P/A coefficient from the measured value of the standard density sample having higher density, even if the mass number is a mass number for which the P/A coefficient has already been determined in accordance with the process of the first representative embodiment described above with reference to FIG. 2, as to the mass number for which it is determined that influence of the molecular ion interference cannot be ignored, the signal intensity of the mass number in another standard density sample containing higher density of element of the mass number may be measured within the calibration range so that the P/A coefficient of the mass number can be determined again. Notably, the degree of the influence of the molecular ion interference can be known from the signal intensity at zero density in the working curve of the element, which is generated from the signal intensity measured values of at least two different densities for the element of the mass number.

As described above, the present teachings can be applied to a typical ICP-MS having the structure of measuring both the pulse count value and the analog current value is described. However, it is clear that the present teachings can generally be applied to any ICP-MS having a structure in which the ion measuring part (e.g., ion measuring part 40 depicted in FIG. 1) for detecting and measuring the signal intensity covers the signal intensity range having higher signal intensity and the signal intensity range having lower signal intensity by two different measurement methods, in order to support a wide dynamic range of the measured signal of the ICP-MS, where the two measurement methods have an overlapping effective signal intensity range.

In other words, in the first embodiment described above with reference to FIG. 2, by replacing the pulse count value and the analog current value with one and the other of measured values measured by the above-mentioned two measurement methods, a conversion coefficient between them can be determined similarly to the first embodiment. More specifically, when the standard density sample for density calibration is measured, a ratio between a measured value of one method and a measured value of the other method measured in the calibration range that is the overlapping signal intensity range in which the measured values of the measurement methods are both effective is calculated. After the ion transmission ratio of the ion lens 30 is adjusted by adjusting the voltage applied to the ion lens 30 allowing the signal intensity to be determined within the calibration range, a ratio between a measured value of one method and a measured value of the other method, which are measured in the calibration range, is calculated. In this manner, the one measured value can be converted into the other measured value. The same is true for conversion in the opposite direction.

Thus, in the measurement of the standard density sample introduced into the ICP-MS 1 for one density calibration, it is possible to obtain the conversion coefficient from one measured value of one measurement method and one measured value of the other measurement method corresponding to the same signal intensity in the calibration range, for each of the mass numbers to be targets of determination of the conversion coefficient. Using the conversion coefficient, it is possible to convert the measured value that is measured by one measurement method corresponding to any signal intensity into a measured value corresponding to the signal intensity to be measured by the other measurement method, for each of the mass numbers. Thereby, it is possible to perform "one point calibration" of the conversion coefficient.

2. Second Representative Embodiment

The P/A coefficient estimation method according to the present teachings utilizes the above-mentioned fact that there is a correlation that can be approximated well by a certain functional expression between the P/A coefficient sequences determined from different measurements with respect to the same mass number, to thereby estimate an unknown P/A coefficient.

In this embodiment of the present teachings, in ICP-MS 1, P/A coefficients of k ($k \geqq 1$) different mass numbers $m_1$, $m_2$, . . . , and $m_k$ in the sample to be measured (hereinafter, referred to as user P/A coefficients) are determined to be $y_1$, $y_2$, . . . , and $y_k$, respectively. If a P/A coefficient of any mass number $\alpha$ except the mass numbers in the sample to be measured is not determined, the P/A coefficient in the mass number $\alpha$ is estimated as follows:

i) Store P/A coefficients determined in advance, for each of as many as possible mass numbers including the k mass numbers and the mass number $\alpha$, which can be targets of measurement, preferably all mass numbers (hereinafter, referred to as reference P/A coefficients) in the ICP-MS 1; and ii) Determine a functional expression ($y=f(x)$) that expresses an appropriate straight line or curve relationship indicating a relationship between the user P/A coefficient sets ($y_1$, $y_2$, . . . , $y_k$) and corresponding subsets ($x_1$, $x_2$, . . . , $x_k$) determined respectively for mass numbers $m_1$, $m_2$, . . . , $m_k$ that are the same as k mass numbers among the reference P/A coefficient sets.

iii) Set y determined by substituting the reference P/A coefficient of the mass number a stored in the ICP-MS 1 into x in y=f(x) as an estimated value of the P/A coefficient of the mass number a in the ICP-MS 1.

Figure 7:
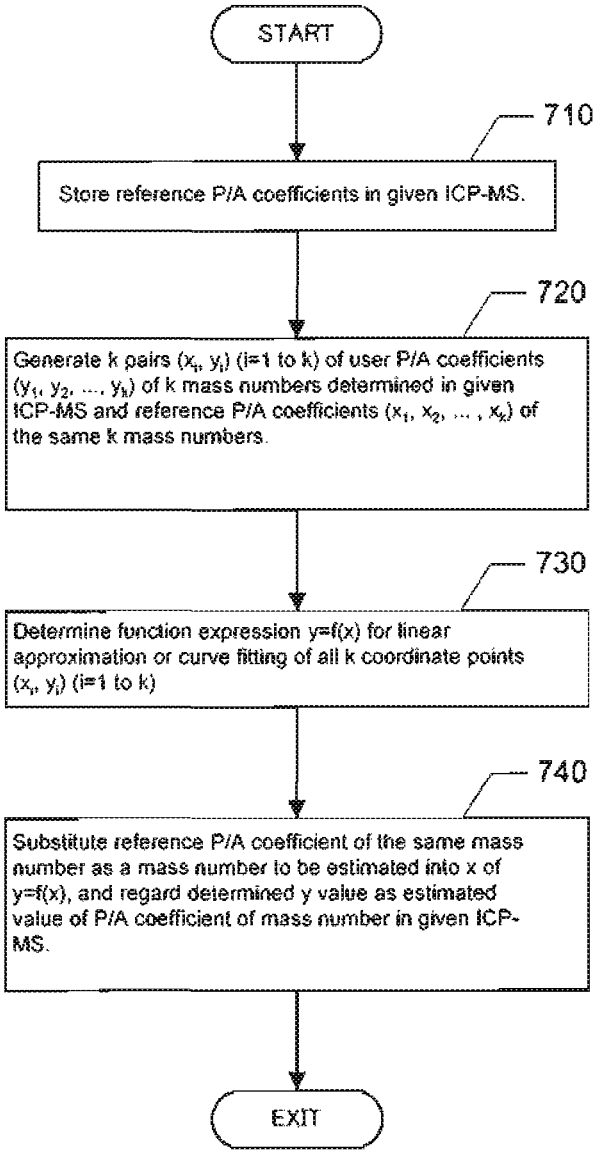
FIG. 7 is a flow chart illustrating a process of a representative embodiment.

Operation in the case where the P/A coefficient estimation method of the second representative embodiment is performed in the ICP-MS 1 depicted in FIG. 1 is described with reference to the flowchart illustrated in FIG. 7. In accordance with one illustrative implementation of the second representative embodiment, the series of processes for the P/A coefficient determination described above with reference to FIG. 7 may be performed by operating individual components ("blocks") illustrated in FIG. 1 on the basis of control by the software incorporated in the system controller 60.

Figure 8:
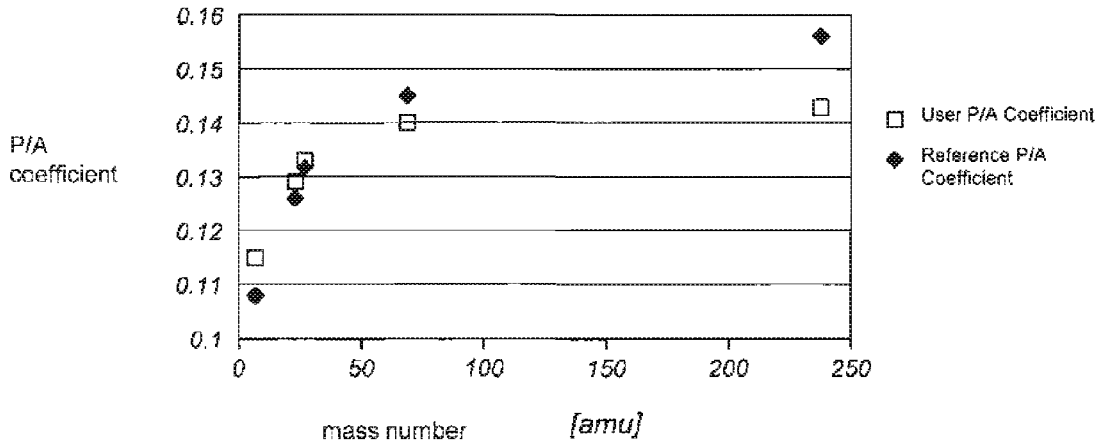
FIG. 8 is a graph in which user P/A coefficients of five mass numbers (indicated by squares) and reference P/A coefficients of the same five mass numbers (indicated by solid black rhombuses) are plotted with respect to the mass numbers.

In the presently described embodiment, when the sample to be measured is measured, the P/A coefficients of five different mass numbers (i.e., k=5) determined by performing the conventional P/A coefficient determining method using a predetermined sample for P/A coefficient calibration are regarded as the user P/A coefficients. However, as described below, in order to ensure that the estimation accuracy of the P/A coefficient according to the present teachings is acceptable, the user P/A coefficients of mass numbers besides the five mass numbers are also determined. Specifically, and by way of example, the five mass numbers are 7, 23, 27, 69, and 238 amu, and the user P/A coefficients thereof are determined to be 0.115151, 0.129762, 0.133808, 0.140516, and 0.14315, respectively (hereinafter, referred to as $y_1$, $y_2$, $y_3$, $y_4$, and $y_5$, respectively). Each of the five user P/A coefficients is associated with a corresponding mass number and is stored in the memory of the operation processor 65 in the ICP-MS 1. The five points indicated by squares in the graph of FIG. 8 are points where the five user P/A coefficients determined for the five mass numbers are plotted.

First, in Step 710, the P/A coefficients determined in advance for all mass numbers that can be targets of measurement and including the five mass numbers are stored in the memory in the operation processor 65 of the ICP-MS 1 as the reference P/A coefficients. The reference P/A coefficient can be determined by measuring a predetermined sample for P/A coefficient calibration in the ICP-MS 1 similarly to the conventional method, or by measuring a predetermined standard density sample in accordance with the P/A coefficient determining method of the present teachings described with reference to the first embodiment described above. The five points of black rhombuses in the graph of FIG. 8 are plotted points corresponding to the reference P/A coefficients of the same five mass numbers as those for which the five user P/A coefficients are determined among the reference P/A coefficients determined as described above (which are 0.108472, 0.126415, 0.132952, 0.14518, and 0.156814, and hereinafter, referred to as $x_1$, $x_2$, $x_3$, $x_4$, and $x_5$, respectively).

Figure 9:
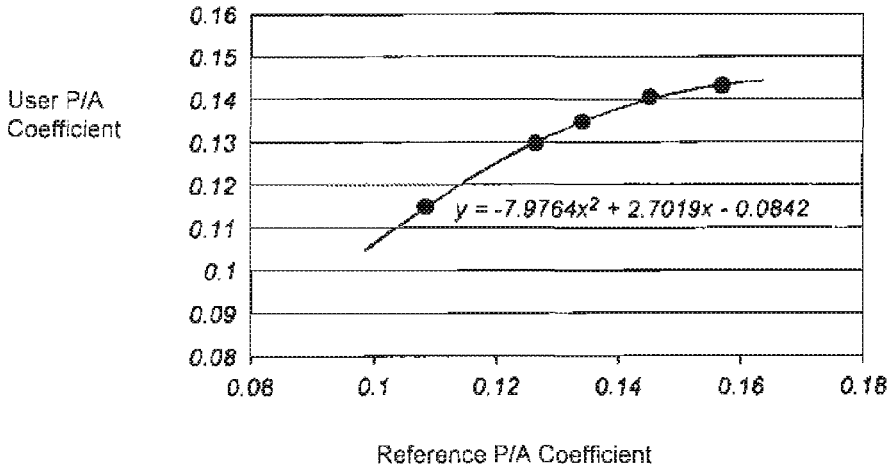
FIG. 9 is a graph in which the horizontal axis (x axis) and the vertical axis (y axis) represent the reference P/A coefficient and the user P/A coefficient, respectively, and (x, y) coordinates of the reference P/A coefficient (x) and the user P/A coefficient (y) are plotted with respect to the five mass numbers. The solid line curve indicates a quadratic curve approximating the plotted points.

Next, in Step 720, the operation processor 65 reads out the five user P/A coefficients $y_1$, $y_2$, $y_3$, $y_4$, and $y_5$, and the reference P/A coefficients $x_1$, $x_2$, $x_3$, $x_4$, and $x_5$ corresponding to the user P/A coefficients from the memory of the operation processor 65 so as to generate five data pairs $(x_i, y_i)$ (i=1 to 5). The five points of dots in the graph of FIG. 9 are (x, y) coordinate points of the reference P/A coefficient (x) and the user P/A coefficient (y) in the plane having the horizontal axis (x axis) and the vertical axis (y axis) to represent the reference P/A coefficient and the user P/A coefficient, respectively, in which the five mass numbers are plotted. It may be understood from the plotted coordinate points that there is a relationship between the reference P/A coefficient sequence and the user P/A coefficient sequence, which can be approximated by a particular curve.

Next, in Step 730, the operation processor 65 determines the functional expression modeling a straight line or a curve that fits best the set of the coordinate points, by using a known approximation method such as a multinomial approximation. The curve displayed by the solid line in FIG. 9 is a quadratic curve determined by using quadratic polynomial approximation based on a known least squares method with respect to the five coordinate points, and the functional expression is determined to be $y=-7.9764x_2+2.7019x-0.0842$.

Next, in Step 740, using the functional expression determined as described above, the P/A coefficient is estimated for a desired mass number that is not determined by the measurement for the P/A coefficient determination in the ICP-MS 1 (corresponding to the mass number for which the P/A coefficient is required to be estimated among the mass numbers for which the P/A coefficients are not determined in the sample to be measured). The reference P/A coefficient set can be determined to cover all the mass numbers to be targets of the measurement. Therefore, the reference P/A coefficient set usually additionally includes the reference P/A coefficient of the desired mass number for which the P/A coefficient is required to be estimated in the sample to be measured. Therefore, a y value determined by substituting the value of the reference P/A coefficient of the desired mass number as x into the above-mentioned functional expression is regarded as the estimated value of the P/A coefficient of the desired mass number that is measured or is to be measured by the ICP-MS 1.

For purposes of illustration, a case of estimating the P/A coefficient of the mass number 133 is described. The reference P/A coefficient of the mass number 133 is determined to be 0.150771 and is stored in the memory of the operation processor 65 of the ICP-MS 1 as described above. The operation processor 65 reads out the reference P/A coefficient of the mass number 133 from the memory and substitutes the reference P/A coefficient as x into the functional expression of $y=-7.9764x_2+2.7019x-0.0842$ so as to calculate a value of y. The operation processor 65 determines the calculated value of y (0.14185 in this example) as the estimated value of the P/A coefficient of the mass number 133 in the ICP-MS 1. The P/A coefficient of the mass number 133 determined together with the five user P/A coefficients is 0.142044.

Figure 10:
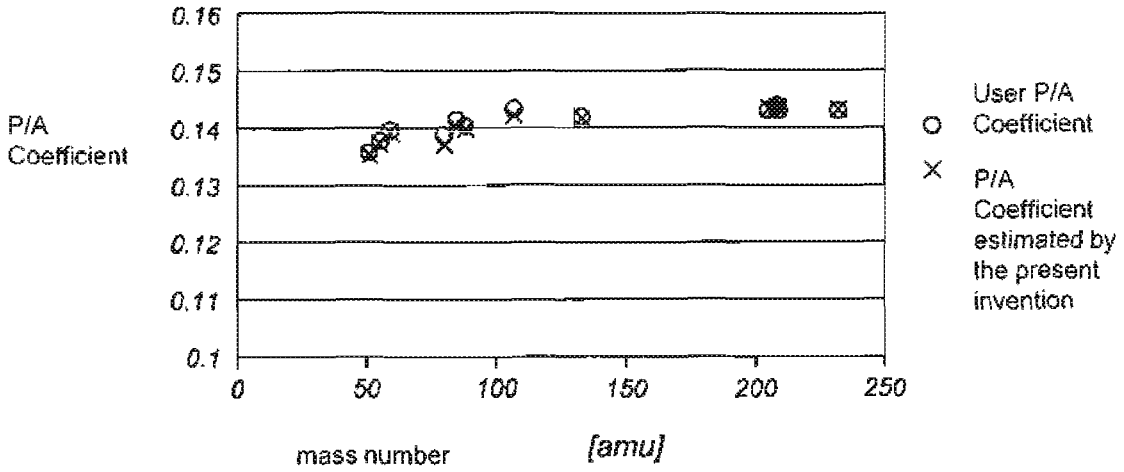
FIG. 10 is a graph in which P/A coefficients estimated by the P/A coefficient estimation method according to representative embodiments with respect to some mass numbers in a certain ICP-MS (indicated by crosses) and P/A coefficients determined as a result of actual measurement for P/A coefficient determination with respect to the same mass numbers in the same ICP-MS (indicated by open circles) are plotted.
Figure 11:
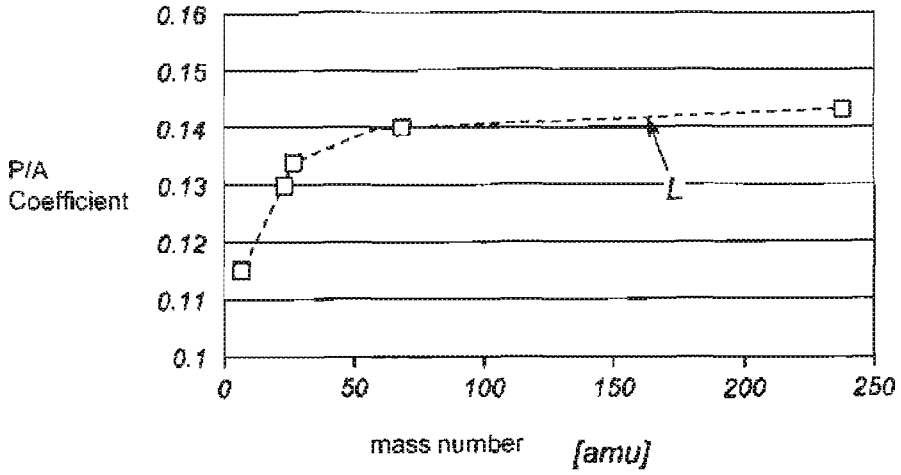
FIG. 11 is a graph showing a P/A coefficient estimation method by a known linear interpolation based on dependence of the P/A coefficient on the mass number.

FIG. 10 is a graph in which the user P/A coefficients of other mass numbers determined together with the P/A coefficients of the five mass numbers are plotted with open circles by performing the P/A coefficient determining method as described above when the sample to be measured is measured in the ICP-MS 1, and the P/A coefficients estimated by the P/A coefficient estimation method for the same mass numbers are plotted with crosses. From this graph, it is understood that it is possible to obtain the estimated value approximated to be the P/A coefficients that would be actually determined from the measured signal intensity value for the P/A coefficient determination according to this P/A coefficient estimation method.

Although the case of five user P/A coefficients (i.e., k=5) is described above, the P/A coefficient estimation method of the present teachings can be applied to the case where another number of user P/A coefficients are determined. For instance, in the case where k=1, namely only one user P/A coefficient is determined, the relationship with the corresponding reference P/A coefficient is determined to be a proportional relationship so that the determined functional expression becomes an equation corresponding to a straight line passing through the origin. The functional expression modeling the relationship with the corresponding reference P/A coefficient becomes a linear polynomial expression when k=2, and the functional expression is a quadratic polynomial expression when k=3.

In this way, according to the P/A coefficient estimation method of the present teachings, even if there is a mass number for which the P/A coefficient of the sample to be measured is not determined in a given ICP-MS, the P/A coefficient of the mass number can be relatively correctly estimated.

The series of processes including the above-mentioned multinomial approximation can be performed by software incorporated in the operation processor 65. Alternatively, the series of processes may be performed by one of the system controller 60 and the operation processor 65, or may be performed and shared by both of them appropriately, depending on design requirements.

The reference P/A coefficient that is used in this embodiment may be determined by other methods than that described above, for example, by measuring a predetermined sample for P/A coefficient calibration similarly to the conventional method in another ICP-MS, or by measuring a predetermined standard density sample in accordance with the present teachings described above with reference to the first embodiment. In either case, it is possible to use the sample for determining the reference P/A coefficient, which contains as many elements as possible, preferably elements of all mass numbers that can be targets of the P/A coefficient determination, and has a density necessary for determining the effective P/A coefficient for each of the mass numbers. Further, when using, in the ICP-MS 1, the reference P/A coefficient determined in another ICP-MS, it is possible to obtain the reference P/A coefficient having higher reliability by preparing a plurality of other ICP-MS's and by using an average value of the P/A coefficients determined for mass numbers by the plurality of ICP-MS's for each mass number as the reference P/A coefficient of each mass number. Thus, it can be expected that the P/A coefficient estimated value having higher reliability can be determined.

In addition, the user P/A coefficient is determined from the measured value of the predetermined sample for P/A coefficient calibration measured by the ICP-MS 1 as described above in this embodiment. However, in the ICP-MS 1, the user P/A coefficient may be determined from the measured value of the predetermined standard density sample according to the present teachings described above with reference to the first embodiment.

In addition, as described above with reference to the first and second embodiments, each of the operation processes in the P/A coefficient determining method and the P/A coefficient estimation method in the present teachings can be performed by software incorporated in the system controller 60 and/or the operation processor 65 disposed in the ICP-MS 1. However, the signal intensity data measured by the ICP-MS 1 may be transmitted to an external computing device such as a personal computer disposed externally, so that the operation process can be performed by the computing device.

Finally, when both the P/A coefficient determination means of the present teachings described above with reference to the first embodiment and the P/A coefficient estimation means of the present teachings described above with reference to the second embodiment are incorporated in one ICP-MS, as described above, possibility that the P/A coefficient of a desired mass number can be estimated to be higher than that in the case where the conventional ICP-MS is used. In other words, according to the P/A coefficient determination means of the present teachings, even if the user forgot to determine the P/A coefficient, the user only has to operate for the density calibration. With this, in general, the P/A coefficient of at least one mass number in the standard density sample introduced into the ICP-MS 1 for the density calibration can be determined automatically. By using the P/A coefficient estimation means of the present teachings for at least one mass number, the P/A coefficient of the desired mass number can be estimated. On the other hand, according to a combination of the conventional P/A coefficient determining method and the conventional P/A coefficient estimation method described above, if the user skipped the operation for the P/A coefficient determination by mistake or intentionally, the P/A coefficient cannot be determined for any of the mass numbers in the sample to be measured. Therefore, the P/A coefficient of the desired mass number cannot be estimated.

Although the present teachings described above with reference to the particular embodiments so that the present teachings can be understood sufficiently, it is clear for a skilled person in the art that specific details are not necessary for embodying the present teachings. The above description about the particular embodiments of the present teachings is described for exemplification and illustration. It is not intended not only to be all-inclusive description of the present teachings by the particular embodiments or to limit the present teachings to the disclosed embodiments. In view of the above-mentioned description, it is clear that various modifications and deformations can be performed. It is intended that the scope of the present invention be defined by the attached claims and equivalent thereof.

What is claimed is:

1. An inductively coupled plasma mass spectroscopy apparatus, comprising:

a sample input configured to introduce a sample to be measured;

an ionizer configured to ionize an element in the sample;

an ion lens into which the ionized element is provided, wherein the ion lens is configured to focus the ionized element;

a mass analyzer configured to segregate the ionized element;

an ion measuring part configured to measure a signal intensity corresponding to a number of ions having a mass number segregated by the mass analyzer as a pulse count value and an analog current value; and an operation processor configured to determine a pulse-to-analog (P/A) coefficient for converting the analog current value into the pulse count value from the analog current value measured by the ion measuring part and the corresponding pulse count value, wherein the operation processor is configured to determine the P/A coefficient of the mass number from the analog current value and the pulse count value corresponding to the signal intensity of the mass number.

2. An inductively coupled plasma mass spectroscopy apparatus as claimed in claim 1, wherein the ion measuring part is configured to measure the signal intensity of the mass number for the mass number corresponding to each element in a standard density sample introduced into the inductively coupled plasma mass spectroscopy apparatus for density calibration.

3. An inductively coupled plasma mass spectroscopy apparatus according to claim 1, further comprising:

first means for discriminating the mass number for which the signal intensity measured in the measurement for density calibration is within a calibration range from another mass number for which the signal intensity is above the calibration range;

means for storing the mass number that is discriminated by the first means for discriminating that the signal intensity is above the calibration range;

means for adjusting a voltage applied to the ion lens in a direction of decreasing or increasing a transmission ratio of the ion lens until the signal intensity of at least one of the mass numbers stored in the means for storing is measured within the calibration range, wherein the adjusting is repeated until the signal intensity of each of the mass numbers is measured at least one time within the calibration range; and second means for discriminating the mass number among the mass numbers stored in the means for storing for which the signal intensity measured in each adjustment of the voltage applied to the ion lens by the means for adjusting the voltage is within the calibration range, wherein: the operation processor is configured to determine the P/A coefficient of the mass number from the pulse count value and the analog current value corresponding to the signal intensity with respect to the mass number discriminated to have the signal intensity within the calibration range by the first means for discriminating; and the operation processor is further configured to determine the P/A coefficient of the mass number from the pulse count value and the analog current value corresponding to the signal intensity, with respect to the mass number discriminated to have the signal intensity within the calibration range by the second means for discriminating in each adjustment of the applied voltage.

4. An inductively coupled plasma mass spectroscopy apparatus according to claim 3, wherein the means for controlling further controls the inductively coupled plasma mass spectroscopy apparatus to perform automatically a series of processes from the measurement for density calibration performed on the standard density sample to the determination of the P/A coefficients of all the mass numbers stored in the means for storing.

5. An inductively coupled plasma mass spectroscopy apparatus according to claim 1, further comprising means for controlling the operation processor to not determine the P/A coefficient for the mass number for which the P/A coefficient has been once determined among the mass numbers stored in the means for storing.

6. A method of determining a pulse-to-analog (P/A) coefficient for converting an analog current value into a pulse count value in an inductively coupled plasma mass spectroscopy apparatus configured to generate the pulse count value and the analog current value as a signal intensity indicating a density of an element in a sample to be measured, the method comprising:

introducing the sample to be measured;

ionizing an element in the sample to be measured;

focusing ions of the ionized element;

segregating the ions after the focusing for each mass number;

measuring a signal intensity corresponding to a number of ions of the mass number segregated as a pulse count value and an analog current value; and determining the P/A coefficient of the mass number from the analog current value and the pulse count value measured for the mass number.

7. A method according to claim 6, wherein:

the inductively coupled plasma mass spectroscopy apparatus further comprises means for controlling a voltage to be applied to the ion lens; and the determining the P/A coefficient comprises:

measuring the signal intensity of the mass number included in the standard density sample in the measurement for density calibration with respect to the standard density sample;

discriminating a mass number having the signal intensity within a calibration range and a mass number having the signal intensity above the calibration range among mass numbers for which the signal intensity has been measured;

storing the mass number that is discriminated to have the signal intensity above the calibration range in the discriminating of the mass number;

determining the P/A coefficient of the mass number from the pulse count value and the analog current value corresponding to the signal intensity with respect to the mass number that is discriminated to have the signal intensity within the calibration range in the discriminating of the mass number;

adjusting the voltage applied to an ion lens in a direction of decreasing or increasing a transmission ratio of the ion lens until the signal intensity of at least one of all the mass numbers stored in the storing step is measured within the calibration range by the means for controlling a voltage, and repeating the adjustment until the signal intensity of each of all the mass numbers is measured at least one time within the calibration range; and a step of performing the following steps every time the applied voltage is adjusted in the step of adjusting the applied voltage, the steps including:

a second measurement step of measuring a signal intensity of the mass number stored in the storing step;

a second discrimination step of discriminating a mass number having the signal intensity measured in the second measurement step within the calibration range; and a second P/A coefficient determination step of determining a P/A coefficient of the mass number from the pulse count value and the analog current value corresponding to the signal intensity measured in the second measurement step with respect to the mass number discriminated in the second discrimination step.

8. A method according to claim 7, wherein a series of processes from the measurement for density calibration performed on the standard density sample to determination of the P/A coefficients of all the mass numbers stored in the storing step is automatically performed.

9. A method according to claim 6, wherein the P/A coefficient is not determined for the mass number for which the P/A coefficient has been once determined in one of the first P/A coefficient determination step and the second P/A coefficient determination step.

10. A non-transitory computer readable medium having a computer readable program code embodied therein, the computer readable program code adapted to be executed to implement a method of determining a coefficient for converting an analog current value into a pulse count value in an inductively coupled plasma mass spectroscopy apparatus configured to generate the pulse count value and the analog current value as a signal intensity indicating a density of an element in a sample to be measured, the method comprising:

introducing the sample to be measured;

ionizing an element in the sample to be measured;

introducing the ionized element;

focusing ions;

segregating the ions after the focusing for each mass number;

measuring a signal intensity corresponding to a number of ions of the mass number segregated as a pulse count value and an analog current value; and determining the coefficient of the mass number from the analog current value and the pulse count value measured for the mass number.

11. A non-transitory computer readable medium as claimed in claim 10, wherein:

the inductively coupled plasma mass spectroscopy apparatus further comprises means for controlling a voltage to be applied to the ion lens; and the determining the coefficient comprises:

measuring the signal intensity of the mass number included in the standard density sample in the measurement for density calibration with respect to the standard density sample;

discriminating a mass number having the signal intensity within a calibration range and a mass number having the signal intensity above the calibration range among mass numbers for which the signal intensity has been measured;

storing the mass number that is discriminated to have the signal intensity above the calibration range in the discriminating of the mass number;

determining the P/A coefficient of the mass number from the pulse count value and the analog current value corresponding to the signal intensity with respect to the mass number that is discriminated to have the signal intensity within the calibration range in the discriminating of the mass number;

adjusting the voltage applied to an ion lens in a direction of decreasing or increasing a transmission ratio of the ion lens until the signal intensity of at least one of all the mass numbers stored in the storing step is measured within the calibration range by the means for controlling a voltage, and repeating the adjustment until the signal intensity of each of all the mass numbers is measured at least one time within the calibration range; and a step of performing the following steps every time the applied voltage is adjusted in the step of adjusting the applied voltage, the steps including:

a second measurement step of measuring a signal intensity of the mass number stored in the storing step;

a second discrimination step of discriminating a mass number having the signal intensity measured in the second measurement step within the calibration range; and a second P/A coefficient determination step of determining a P/A coefficient of the mass number from the pulse count value and the analog current value corresponding to the signal intensity measured in the second measurement step with respect to the mass number discriminated in the second discrimination step.

12. A non-transitory computer readable medium according to claim 10, wherein the P/A coefficient is not determined for the mass number for which the P/A coefficient has been once determined in one of the first P/A coefficient determination step and the second P/A coefficient determination step.

13. A non-transitory computer readable medium according to claim 10, wherein a series of processes from the measurement for density calibration performed on the standard density sample to determination of the P/A coefficients of all the mass numbers stored in the storing step is automatically performed.

14. An inductively coupled plasma mass spectroscopy apparatus, comprising:

a sample input;

an ionizer configured to ionize an element from the sample input;

an ion lens into configured to focus the ionized element;

means for controlling a voltage to be applied to the ion lens;

a mass analyzer for configured to segregate the ions focused by the ion lens for each mass number;

an ion measuring part configured to measure a signal intensity corresponding to a number of ions of the mass number segregated by the mass analyzer by a first method and a second method that is different from the first method; and an operation processor configured to determine a conversion coefficient for converting any measured value determined by the first method to a corresponding measured value to be determined by the second method, from measured values measured by the first method and the second method, for each mass number with respect to a signal intensity within a calibration range that is an overlapping range of signal intensity ranges in which the measurement can be performed by the first method and the second method, the inductively coupled plasma mass spectroscopy apparatus configured to:

i) determine the conversion coefficient by the operation processor from the measured value corresponding to the signal intensity measured by the first method and the second method in the ion measuring part for a mass number having the signal intensity within the calibration range, which is measured by the ion measuring part for density calibration with respect to the mass number corresponding to each element in a standard density sample introduced into the inductively coupled plasma mass spectroscopy apparatus for the density calibration; and ii) determine the conversion coefficient by the operation processor from the measured value corresponding to the signal intensity measured by the first method and the second method in the ion measuring part after the means for controlling the voltage adjusts an ion transmission ratio of the ion lens by changing the voltage applied to the ion lens so that the signal intensity of each of all mass numbers is within the calibration range at least one time for a mass number having the signal intensity above the calibration range, which is measured by the ion measuring part for the density calibration with respect to the mass number corresponding to each element in the standard density sample introduced into the inductively coupled plasma mass spectroscopy apparatus for the density calibration, whereby a sample other than the standard density sample is not necessary as a sample for determining a coefficient of the mass number.

15. A method of determining a conversion coefficient for converting a measured value determined by a first method into a corresponding measured value to be determined by a second method that is different from the first method in an inductively coupled plasma mass spectroscopy apparatus that is configured to measure a signal intensity indicating a density of an element in a sample to be measured by the first method and the second method, the inductively coupled plasma mass spectroscopy apparatus comprising:

a sample input for introducing the sample to be measured;

an ionizer for ionizing an element in the sample to be measured introduced from the sample input;

an interface for introducing the ionized element;

an ion lens into which the ionized element is introduced from the interface and which includes an ion lens configured to focus ions that have passed through the interface;

means for controlling a voltage to be applied to the ion lens;

a mass analyzer configured to segregate the ions focused by the ion lens for each mass number;

an ion measuring part configured to measure the signal intensity corresponding to a number of ions of the mass number segregated by the mass analyzer by the first method and the second method; and an operation processor configured to determine the conversion coefficient from the measured values determined by the first method and the second method for each mass number with respect to a signal intensity within a calibration range that is an overlapping range of signal intensity ranges in which the measurement can be performed by the first method and the second method, the method comprising determining the conversion coefficient from;

i) a measured value corresponding to the signal intensity determined by the first method and the second method for a mass number having the signal intensity within the calibration range, which is determined for density calibration with respect to a mass number corresponding to each element in a standard density sample introduced to the inductively coupled plasma mass spectroscopy apparatus for the density calibration; and ii) a measured value corresponding to the signal intensity determined by the first method and the second method after adjusting an ion transmission ratio of the ion lens by changing the voltage applied to the ion lens so that the signal intensity of each of all the mass numbers is within the calibration range at least one time for a mass number having the signal intensity above the calibration range, which is determined for the density calibration with respect to the mass number corresponding to each element in the standard density sample introduced to the inductively coupled plasma mass spectroscopy apparatus for the density calibration, whereby a sample other than the standard density sample is not necessary as a sample for determining the conversion coefficient of the mass number.

* * * * *

UNITED STATES PATENT AND TRADEMARK OFFICE

CERTIFICATE OF CORRECTION

PATENT NO. : 8,530,829 B2
APPLICATION NO. : 13/237179
DATED : September 10, 2013
INVENTOR(S) : Kazushi Hirano et al.

It is certified that error appears in the above-identified patent and that said Letters Patent is hereby corrected as shown below:

In the Claims

In column 23, line 16, in claim 15, delete "from:" and insert -- from; --, therefor.

Signed and Sealed this
Thirteenth Day of May, 2014

Michelle K. Lee

Michelle K. Lee
*Deputy Director of the United States Patent and Trademark Office*